US008313810B2

(12) United States Patent
Helmick et al.

(10) Patent No.: US 8,313,810 B2
(45) Date of Patent: Nov. 20, 2012

(54) METHODS FOR FORMING AN OXIDE-DISPERSION STRENGTHENED COATING

(75) Inventors: David Andrew Helmick, Wyomissing, PA (US); George Albert Goller, Greenville, SC (US); Raymond Joseph Stonitsch, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/081,906

(22) Filed: Apr. 7, 2011

(65) Prior Publication Data

US 2012/0258253 A1 Oct. 11, 2012

(51) Int. Cl.
*B05D 1/08* (2006.01)
*B05D 1/12* (2006.01)

(52) U.S. Cl. ..... 427/455; 427/456; 427/190; 427/191

(58) Field of Classification Search ..... 427/455, 427/456, 190, 191
See application file for complete search history.

(56) References Cited

U.S. PATENT DOCUMENTS 4,101,713 A * 7/1978 Hirsch et al. ..... 428/554
4,532,191 A 7/1985 Humphries et al.
5,712,050 A 1/1998 Goldman et al.
5,741,556 A * 4/1998 Taylor et al. ..... 427/453
6,136,453 A 10/2000 Ritter et al.
7,166,272 B2 1/2007 Fujisawa
7,601,431 B2 10/2009 Pareek et al.
2008/0032105 A1 2/2008 Taylor

FOREIGN PATENT DOCUMENTS

EP 0532252 A1 3/1993

OTHER PUBLICATIONS

Wang, Hong-yu et al., "Microstructure of nanometer $A1_2O_3$ dispersion strengthened Ni-based high-temperature protective coatings by laser cladding", pp. 586-591, Trans. Nonferrous Met. Soc. China 19, 2009.
Co-pending U.S. Appl. No. 12/562,527, filed Sep. 18, 2009.
Co-pending U.S. Appl. No. 12/570,011, filed Sep. 30, 2009.
Search Report and Written Opinion from corresponding EP Application No. 12162866.3-1215 dated Jun. 5, 2012.

* cited by examiner

*Primary Examiner* — Frederick Parker
(74) *Attorney, Agent, or Firm* — Dority & Manning, P.A.

(57) ABSTRACT

A method for forming an oxide-dispersion strengthened coating on a metal substrate is disclosed. The method generally includes comminuting MCrAlY alloy particles to form an oxygen-enriched powder, wherein at least about 25% by volume of the MCrAlY alloy particles within the oxygen-enriched powder have a particle size of less than about 5 μm. Additionally, the method includes applying the oxygen-enriched powder to the metal substrate to form a coating and heating the oxygen-enriched powder to precipitate oxide dispersoids within the coating.

16 Claims, 2 Drawing Sheets

METHODS FOR FORMING AN OXIDE-DISPERSION STRENGTHENED COATING

FIELD OF THE INVENTION

The present invention relates generally to protective coatings for metal substrates and, more particularly, to methods for forming an oxide-dispersion strengthened coating on metal substrates.

BACKGROUND OF THE INVENTION

The operating environment within a gas turbine is both thermally and chemically hostile. For example, operating temperatures within a gas turbine may range from about 1200° F. to about 2200° F. (about 650° C. to about 1200° C.), depending on the type of turbine engine being used. Such high temperatures combined with the oxidizing environment of a gas turbine generally necessitates the use of a nickel- or cobalt-containing specialty alloy having a high oxidation resistance and, thereby, an acceptable operating life within the turbine. Accordingly, gas turbine components are typically formed from nickel alloy steels, nickel-based or cobalt-based superalloys or other specialty alloys.

Significant advances in the high temperature capabilities of such specialty alloys have been achieved through the use of oxidation resistant environmental coatings capable of protecting the alloys from oxidation, hot corrosion, etc. For example, thermal barrier coating (TBC) systems are typically used in turbine components to insulate the components from the high temperatures during thermal cycling. TBC systems typically include a thermal barrier coating disposed on a bond coating which is, in turn, applied to the metal substrate forming the component. The thermal barrier coating normally comprises a ceramic material, such as zirconia. Additionally, the bond coating typically comprises an oxidation-resistant metallic layer designed to inhibit oxidation of the underlying substrate.

Current trends show that less refined fuels are gaining in popularity for use within gas turbines. These less refined fuels include particulate matter that can make its way into the hot gas path of the gas turbine, thereby impinging on the turbine components contained within the hot has path. The continued exposure of turbine components to such particulate matter can lead to erosion damage of the coatings within the TBC system, thereby increasing the likelihood that the underlying metal substrate is subject to oxidation and/or hot corrosion. To address such erosion issues, erosion resistant bond coatings have been developed. However, these erosion resistant bond coatings are typically formed by increasing the size and volume percent of the hard particles (e.g., tungsten carbide, titanium carbide and diamond boron nitride) used in the coating. As a result, the volume percent of the oxide-forming constituents within the coating must be decreased, thereby reducing the overall environmental protectiveness of the coating.

Accordingly, a method for forming an oxide-dispersion strengthened coating that provides erosion resistance without sacrificing environmental protectiveness would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter discloses a method for forming an oxide-dispersion strengthened coating on a metal substrate. The method generally includes comminuting MCrAlY alloy particles to form an oxygen-enriched powder, wherein at least about 25% by volume of the MCrAlY alloy particles within the oxygen-enriched powder have a particle size of less than about 5 μm. Additionally, the method includes applying the oxygen-enriched powder to the metal substrate to form a coating and heating the oxygen-enriched powder to precipitate oxide dispersoids within the coating.

In another aspect, the present subject matter discloses a method for forming an oxide-dispersion strengthened coating on a metal substrate. The method generally includes comminuting MCrAlY alloy particles to form an oxygen-enriched powder, wherein at least about 25% by volume of the MCrAlY alloy particles within the oxygen-enriched powder have a particle size of less than about 5 μm. Additionally, the method includes mixing the oxygen-enriched powder with course MCrAlY alloy particles to form an oxygen-enriched powder mixture, applying the oxygen-enriched powder mixture to the metal substrate to form a coating and heating the oxygen-enriched powder mixture to precipitate oxide dispersoids within the coating.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
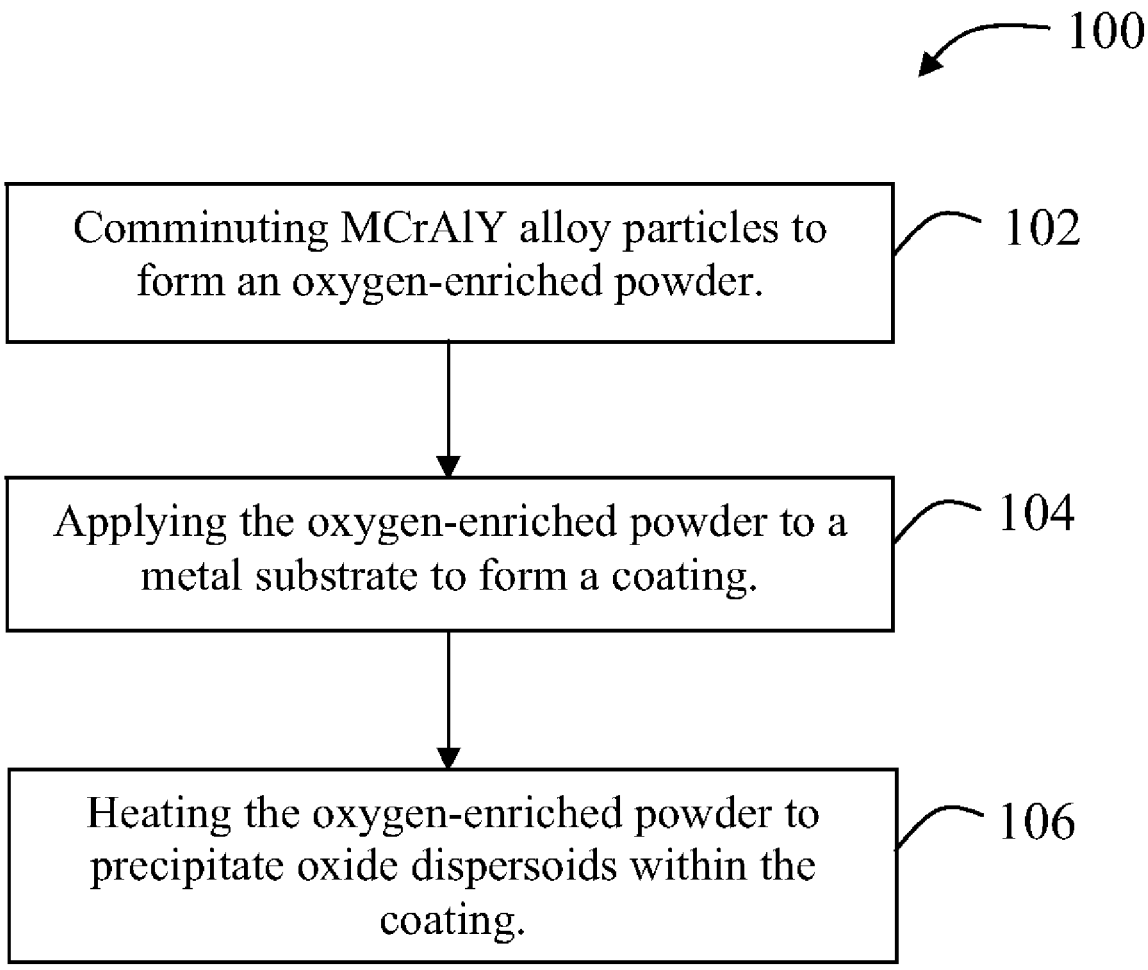
FIG. 1 illustrates a flow diagram of one embodiment of a method for forming an oxide-dispersion strengthened coating on a metal substrate in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a method for forming an oxide-dispersion strengthened coating on a metal substrate designed to be exposed to high temperature environments, such as metal components used in the hot gas path of a gas turbine. In several embodiments, the method includes comminuting stable MCrAlY alloy particles in order to strain and fracture the particles, thereby increasing the surface area of the particles and forming a fine powder. As a result, oxygen may be absorbed into the matrix of the powder, supersaturating the powder with oxygen as new surface oxides form on the freshly fractured particles surfaces. This oxygen-enriched powder may then be applied to the surface of a metal substrate as an oxidation resistant, protective coating and heated to permit the oxygen to react with the constituents of the powder in order to precipitate oxide dispersoids (e.g., nano-scale oxide dispersoids) within the coating. These oxide dispersoids may generally act as defects within the crystalline structure of the coating and may strain the structure to produce a stress fields around the dispersoids. These stress fields may, in turn, resist the flow of dislocations and other material deformations, thereby increasing the strength and erosion resistance of the protective coating. Moreover, because the strengthening is achieved by the oxide-dispersoids instead of increasing the volume percent of the hard particles contained within the coating, the protective coating may also provide the same or similar oxidation resistance as other known oxidation resistant coatings.

Referring now to FIG. 1, there is illustrated one embodiment of a method 100 for forming an oxide-dispersion strengthened coating on a metal substrate. Generally, the method 100 includes comminuting MCrAlY alloy particles to form an oxygen-enriched powder 102, applying the oxygen-enriched powder to the metal substrate to form a coating 104 and heating the oxygen-enriched powder to precipitate oxide dispersoids within the coating 106. It should be appreciated that, although the various elements 102, 104, 106 of the disclosed method 100 are illustrated in a particular order in FIG. 1, the elements may generally be performed in any sequence and/or order consistent with the disclosure provided herein.

In 102, MCrAlY alloy particles (wherein M is at least one of iron, cobalt and nickel) are comminuted to form an oxygen-enriched powder. As used herein, the terms "comminuting" and "comminuted" refer generally to the process of reducing the size of particles. The MCrAlY alloy particles may be comminuted using any suitable grinding, milling, crushing and/or pulverizing process known in the art. For example, in one embodiment, the MCrAlY alloy particles may be comminuted using a ball milling process, wherein the particles are placed in a container with a plurality of steel or ceramic balls and rotated to allow the balls to cascade within the container and, thus, grind or crush the particles into a powder. It should be appreciated that, by comminuting the MCrAlY alloy particles, the particles may be continuously fractured and re-fractured, thereby allowing new surface oxides to form on the freshly fractured particles surfaces. Accordingly, the resulting powder may be supersaturated with oxygen or otherwise oxygen-enriched as the oxygen from the surrounding environment is absorbed within the matrix of the powder.

In several embodiments, the particle sizes of the MCrAlY alloy particles may be reduced significantly in 102 in order to enhance the capability of the powder to absorb oxygen. For example, in one embodiment, the MCrAlY alloy particles may be comminuted until at least about 25% by volume of the particles have a particle size of less than about 5 micrometers (μm), such as by comminuting the particles so that greater than about 50% by volume of the particles have a particle size of less than about 5 μm or greater than about 75% by volume of the particles have a particle size of less than about 5 μm or greater than about 90% by volume of the particles have a particle size of less than about 5 μm and all other subranges therebetween. However, in alternative embodiments, it should be appreciated that the MCrAlY alloy particles may be comminuted so that less than about 25% by volume of the particles have a particle size of less than about 5 μm.

In 304, the oxygen-enriched powder is applied to a metal substrate to form a protective coating. In general, the oxygen-enriched powder may be applied to the metal substrate using any suitable application and/or spraying process known in the art. For example, in several embodiments, the oxygen-enriched powder may be applied using a thermal spraying process. Suitable thermal spraying processes may include, but are not limited to, high velocity oxy-fuel (HVOF) spraying processes, vacuum plasma spraying (VPS) processes (also known as low pressure plasma spraying (LPPS) processes), air plasma spraying (APS) processes and cold spraying processes.

Figure 2:
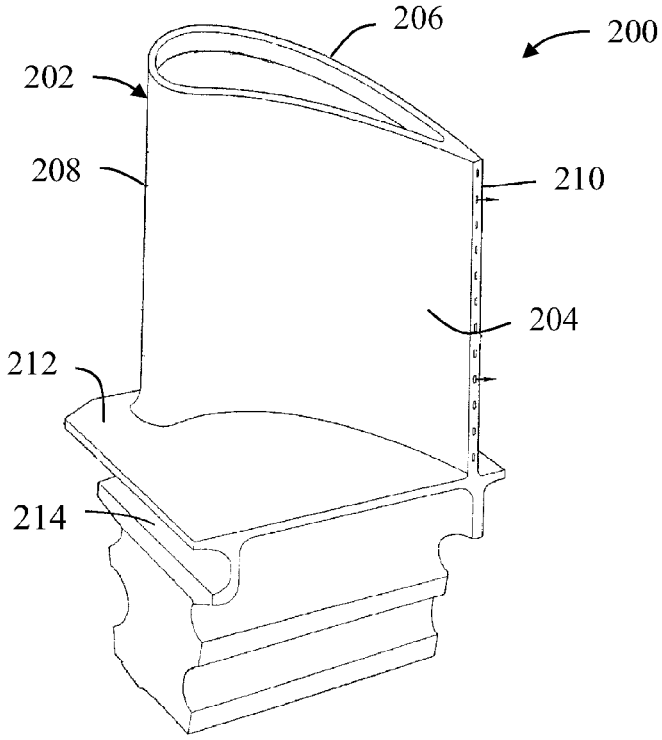
FIG. 2 illustrates a perspective view of one embodiment of a turbine bucket.

Additionally, it should be appreciated that the oxygen-enriched powder may generally be applied to any suitable metal substrate. For example, in several embodiments, the oxygen-enriched powder may be applied to components of a gas turbine (e.g., nozzles, buckets, blades, shrouds, airfoils and the like), as indicated above, or may be applied to any other suitable metal substrates used in high temperature environments, such as selected components of diesel and other types of internal combustion engines. FIG. 2 is provided for purposes of illustrating an environment in which the present subject matter is particularly useful, and depicts a perspective view of one embodiment of a turbine bucket 200 of a gas turbine. As shown, the turbine bucket 200 includes an airfoil 202 having a pressure side 204 and a suction side 206 extending between leading and trailing edges 208, 210. The airfoil 202 generally extends radially outwardly from a substantially planar platform 212. In addition, the turbine bucket 200 includes a root 214 extending radially inwardly from the platform 212 for attaching the bucket 200 to an annular rotor disk (not shown) of the gas turbine. As is generally understood, the airfoil 202 is typically disposed within the hot gas path of the gas turbine and, thus, generally necessitates an oxidation and/or erosion resistant coating to have an acceptable operating life within the gas turbine.

Figure 3:
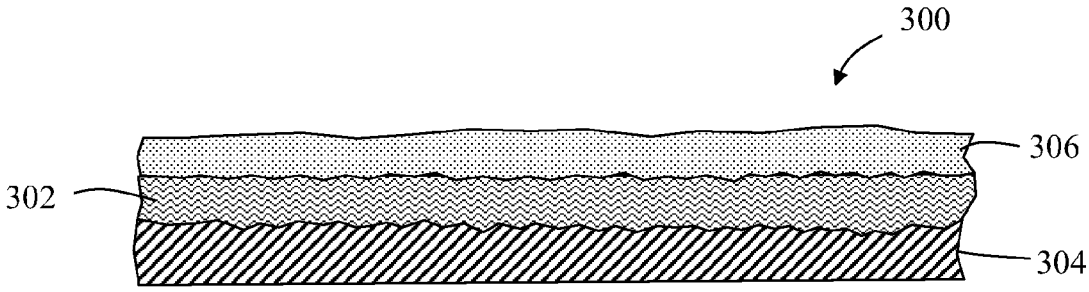
FIG. 3 illustrates a cross-sectional view of a thermal barrier coating system.

Moreover, it should be appreciated that, in several embodiments, the protective coating formed in 104 may comprise the initial bond coating of a thermal barrier coating (TBC) system. For example, FIG. 3 provides a cross-sectional view of one embodiment of a TBC coating system 300. As shown, the TBC coating system 300 generally includes a bond coating 302 covering the surface of a metal substrate 304 and a thermal barrier coating 306 disposed over the bond coating 302. As is generally understood, the thermal barrier coating 306 may be formed from various known ceramic materials, such as zirconia partially or fully stabilized by yttrium oxide, magnesium oxide or other noble metal oxides, and may be applied over the bond coating 302 using any suitable application and/or spraying process, such as the spraying processes described above.

However, in alternative embodiments, it should be appreciated that the protective coating formed in 104 may be used within any other suitable coating system known in the art and/or may be used as a stand-alone protective overlay coating applied to a metal substrate.

Referring still to FIG. 1, in 106, the oxygen-enriched powder is heated or is otherwise thermally processed to precipitate oxide dispersoids within the protective coating. Specifically, by heating the oxygen-enriched powder, the oxygen absorbed within the oxygen-enriched powder may react with the constituents of the MCrAlY alloy particles to form oxide dispersoids within the coating. For example, the oxygen may react with the chromium, aluminum and/or yttrium contained within the particles to form chromium oxide (e.g., $Cr_2O_3$) dispersoids, aluminum oxide (e.g., $Al_2O_3$) dispersoids, yttrium oxide (e.g., $Y_2O_3$) dispersoids and/or dispersoids containing a mixture of such oxides. Additionally, due to the fine powder achieved by comminuting the MCrAlY alloy particles as described above, the oxide dispersoids precipitated out during heating may be relatively small in size. For instance, in one embodiment, the size of the oxide dispersoids may be on the nano-scale, such as by having an average size of less than about 1 μm or less than about 0.5 μm or less than about 0.1 μm and all other subranges therebetween. However, in other embodiments, the oxide dispersoids may have an average size of greater than about 1 μm, such as by having an average size of greater than about 1.5 μm or greater than about 2 μm and all other subranges therebetween.

In several embodiments, the oxygen-enriched powder may be heated or otherwise thermally processed after it has been applied to the metal substrate to form the protective coating. For example, in one embodiment, the metal substrate may be heat-treated subsequent to application of the oxygen-enriched powder in order to precipitate out the oxide dispersoids. Suitable heat treatments may include heating the metal substrate and the oxygen-enriched powder applied thereon to a temperature ranging from about 1000° F. to about 2000° F. and maintaining such temperature for less than about three hours. However, other suitable heat treatments may include heating the metal substrate and oxygen-enriched powder to any suitable temperature for any suitable time period sufficient to allow the oxygen to react with the constituents of the MCrAlY alloy particles, thereby precipitating out the desired oxide dispersoids. Additionally, in embodiments in which the metal substrate is configured as a metal component used within a high temperature environment, the heating of the oxygen-enriched powder may be performed when the metal component is installed within the high temperature environment. For example, it is believed that exposure to the operating temperatures within a gas turbine would be sufficient to precipitate out the oxide dispersoids.

In alternative embodiments, it should be appreciated that the oxygen-enriched powder may be heated or otherwise thermally processed while it is being applied to the metal substrate. For example, the temperatures achieved through the use of certain thermal spraying processes may be sufficient to allow the oxygen absorbed within the oxygen-enriched powder to react with the constituents of the MCrAlY alloy particles.

Additionally, in a particular embodiment of the present subject matter, the disclosed method 100 may also include mixing the oxygen-enriched powder formed in 102 with course MCrAlY alloy particles to form an oxygen-enriched powder mixture. For example, it may be desirable to mix the oxygen-enriched power with course MCrAlY alloy particles to facilitate application of the oxygen-enriched powder onto the metal substrate when using known spraying process that require relatively large particle sizes (e.g., certain APS processes). Moreover, the addition of course MCrAlY alloy particles to the oxygen-enriched powder may also provide a means for achieving a desired degree of surface roughness for the protective coating when the oxygen-enriched powder mixture is applied to the metal substrate. As is generally understood, a certain degree of surface roughness may assist in promoting the adhesion of other coatings on top of the protective coating, such as the thermal barrier coating 306 described above with reference to FIG. 3.

As used herein, the term "course MCrAlY alloy particles" refers to a mixture of MCrAlY alloy particles having an average particle size that is greater than the average particle size of the comminuted MCrAlY alloy particles contained within the oxygen-enriched powder. Thus, in several embodiments, at least about 90% by volume of the course MCrAlY alloy particles may have a particle size that is greater than about 5 μm. For instance, in a particular embodiment, at least 90% by volume of the course MCrAlY alloy particles may have a particle size ranging from about 5 μm to about 110 μm, such as from about 5 μm to about 25 μm or from about 5 μm to about 55 μm or from about 55 μm to about 110 μm and all other subranges therebetween.

Moreover, in another embodiment of the present subject matter, the disclosed method 100 may also include adding an oxide-forming additive to the MCrAlY alloy particles prior to such particles being comminuted. As used herein, the term "oxide-forming additive" refers to any suitable element that may react with oxygen when heated to form oxide dispersoids capable of strengthening the protective coating formed in accordance with aspects of the present subject matter. For example, suitable oxide-forming additives may include, but are not limited to, molybdenum, titanium, tungsten, manganese, chromium, yttrium and mixtures thereof.

By mixing such oxide-forming additives with the MCrAlY alloy particles prior to comminuting the mixture, the additive particles of the oxide-forming additives may be fractured together with the MCrAlY alloy particles, thereby increasing the surface area of the additive particles and allowing surface oxides to form on the newly fractured particle surfaces. As such, when the resulting powder mixture is applied to a metal substrate and heated, the oxygen may react with the constituents of the comminuted MCrAlY alloy particles and additive particles to precipitate out oxide dispersoids. For example, using one or more of the oxide-forming additives described above, the oxide dispersoids formed within the protective coating may include, but are not limited to, molybdenum oxide (e.g., $MoO_2$) dispersoids, titanium oxide (e.g., $Ti_2O_3$) dispersoids, tungsten oxide (e.g., $W_2O_3$) dispersoids, manganese oxide (e.g., $Mn_3O_4$) dispersoids, chromium oxide (e.g., $Cr_2O_3$) dispersoids, yttrium oxide (e.g., $Y_2O_3$) dispersoids, aluminum oxide (e.g., $Al_2O_3$) dispersoids and dispersoids containing a mixture of such oxides Metal components used within high temperature environments are generally described as the "metal substrate" in the present disclosure. However, it should be readily appreciated that the present subject mater is not limited to any particular type of metal substrate and/or components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for forming an oxide-dispersion strengthened coating on a metal substrate, the method comprising:

comminuting MCrAlY alloy particles to form comminuted powder, wherein at least 25% by volume of the MCrAlY alloy particles within the comminuted powder have a particle size of less than 5 μm;

mixing the comminuted powder with additional MCrAlY alloy particles to form a powder mixture, at least 90% by volume of the additional MCrAlY alloy particles having a particle size of greater than 5 μm;

applying the powder mixture to the metal substrate to form a coating; and heating the powder mixture to precipitate oxide dispersoids within the coating.

2. The method of claim 1, wherein comminuting the MCrAlY alloy particles comprises ball milling the MCrAlY particles.

3. The method of claim 1, wherein applying the powder mixture comprises applying the powder mixture using a spraying process.

4. The method of claim 3, wherein the spraying process comprises at least one of a high velocity oxy-fuel spraying process, a vacuum plasma spraying process, an air plasma spraying process and a cold spraying process.

5. The method of claim 1, wherein heating the powder mixture comprises heating the oxygen-enriched powder while the powder mixture is being applied to the metal substrate.

6. The method of claim 1, wherein heating the powder mixture comprises heating the powder mixture after the powder mixture has been applied to the metal substrate to form the coating.

7. The method of claim 1, wherein the oxide dispersoids comprise at least one of yttrium oxide, chromium oxide, aluminum oxide and mixtures thereof.

8. The method of claim 1, wherein the oxide dispersoids have an average size of less than 1 μm.

9. The method of claim 1, further comprising adding an oxide-forming additive to the MCrAlY alloy particles.

10. The method of claim 9, wherein the oxide-forming additive comprises at least one of molybdenum, titanium, tungsten, manganese, chromium and yttrium.

11. The method of claim 1, wherein the coating comprises a bond coating, further comprising applying a thermal barrier coating over the bond coating.

12. A method for forming an oxide-dispersion strengthened coating on a metal substrate, the method comprising:

comminuting MCrAlY alloy particles to form comminuted powder, wherein at least 25% by volume of the MCrAlY alloy particles within the comminuted powder have a particle size of less than 5 μm;

mixing the comminuted powder with additional MCrAlY alloy particles to form powder mixture, at least 90% by volume of the additional MCrAlY alloy particles having a particle size of ranging from 55 μm to 110 μm;

applying the powder mixture to the metal substrate to form a coating; and heating the powder mixture to precipitate oxide dispersoids within the coating.

13. The method of claim 12, further comprising adding an oxide-forming additive to the MCrAlY alloy particles prior to the MCrAlY alloy particles being comminuted.

14. The method of claim 13, wherein the oxide-forming additive comprises at least one of molybdenum, titanium, tungsten, manganese, chromium and yttrium.

15. The method of claim 12, wherein heating the powder mixture comprises at least one of heating the powder mixture while the powder mixture is being applied to the metal substrate and heating the powder mixture after the powder mixture has been applied to the metal substrate to form the coating.

16. The method of claim 12, wherein the oxide dispersoids have an average size of less than about 1 μm.

* * * * *